US008558518B2

(12) United States Patent
Irissou et al.

(10) Patent No.: US 8,558,518 B2
(45) Date of Patent: Oct. 15, 2013

(54) METHODS AND APPARATUSES FOR PHASE-CUT DIMMING AT LOW CONDUCTION ANGLES

(75) Inventors: Pierre Irissou, Sunnyvale, CA (US); Etienne Colmet-Daage, Sunnyvale, CA (US); Bernard Drexler, Gieres (FR)

(73) Assignee: Microsemi Corporation, Aliso Viejo, CA (US)

( * ) Notice: Subject to any disclaimer, the term of this patent is extended or adjusted under 35 U.S.C. 154(b) by 0 days.

(21) Appl. No.: 13/338,049

(22) Filed: Dec. 27, 2011

(65) Prior Publication Data

US 2012/0098505 A1 Apr. 26, 2012

Related U.S. Application Data

(63) Continuation of application No. 12/404,979, filed on Mar. 16, 2009, now Pat. No. 8,102,167.

(60) Provisional application No. 61/039,339, filed on Mar. 25, 2008.

(51) Int. Cl.
*G05F 1/00* (2006.01)

(52) U.S. Cl.
USPC ..... 323/237; 315/194

(58) Field of Classification Search
USPC ..... 315/194, 209 R, 246, 291, 299, 302, 315/307, 308; 323/237
See application file for complete search history.

(56) References Cited

U.S. PATENT DOCUMENTS

| | | | | |
|---|---|---|---|---|
| 5,847,592 | A | 12/1998 | Gleim et al. | |
| 6,229,271 | B1 * | 5/2001 | Liu | 315/291 |
| 6,573,666 | B1 | 6/2003 | Killat | |
| 7,336,463 | B2 | 2/2008 | Russell et al. | |
| 8,102,167 | B2 | 1/2012 | Irissou et al. | |
| 2002/0047608 | A1 | 4/2002 | Takahashi et al. | |
| 2004/0135523 | A1 | 7/2004 | Takahashi et al. | |
| 2005/0110435 | A1 * | 5/2005 | Ballenger et al. | 315/307 |
| 2007/0057641 | A1 | 3/2007 | Russell et al. | |
| 2007/0182347 | A1 * | 8/2007 | Shteynberg et al. | 315/312 |
| 2007/0285028 | A1 | 12/2007 | Tsinker et al. | |
| 2008/0186747 | A1 * | 8/2008 | Balakrishnan et al. | 363/84 |
| 2009/0021180 | A1 | 1/2009 | Underwood et al. | |

(Continued)

FOREIGN PATENT DOCUMENTS

| | | | |
|---|---|---|---|
| JP | 2004-296205 | A | 10/2004 |
| JP | 2006-278009 | A | 10/2006 |
| WO | WO-2009/120555 | A1 | 10/2009 |

OTHER PUBLICATIONS

2009 National Semiconductor Corporation, LM3445, Triac Dimmable Offline LED Driver, Feb. 10, 2009, 26 pgs.

(Continued)

*Primary Examiner* — Adolf Berhane
*Assistant Examiner* — Emily P Pham
(74) *Attorney, Agent, or Firm* — Holland & Hart LLP

(57) ABSTRACT

Methods, systems, and devices are described for sensing a phase-cut dimming signal and outputting a control signal compatible with a switching power circuit. Embodiments of the invention generate at least one of a low-frequency pulse-wave-modulated control signal, an analog output control signal, or a digital (e.g., higher-frequency pulse-wave-modulated) output control signal. Some embodiments further provide preloading and/or startup control functionality to allow proper functioning of the circuitry under small-conduction-angle (i.e., highly dimmed) conditions.

20 Claims, 12 Drawing Sheets

(56) References Cited

U.S. PATENT DOCUMENTS

| | | | | |
|---|---|---|---|---|
| 2009/0195168 | A1* | 8/2009 | Greenfeld | 315/192 |
| 2009/0261744 | A1* | 10/2009 | Chen et al. | 315/199 |
| 2010/0308742 | A1 | 12/2010 | Melanson | |

OTHER PUBLICATIONS

NXP Semiconductors, SSL2101, SMPS IC for Dimmable LED Lighting, Rev. 01, Jan. 19, 2009, 1 pg.

International Search Report, Int'l Pat. App. No. PCT/US2009/037559, dated Aug. 31, 2009, 3pgs.

* cited by examiner

METHODS AND APPARATUSES FOR PHASE-CUT DIMMING AT LOW CONDUCTION ANGLES

CROSS-REFERENCES

This application is a continuation of U.S. patent application Ser. No. 12/404,979, filed on Mar. 16, 2009, entitled "PHASE-CUT DIMMING CIRCUIT," which claims priority from co-pending U.S. Provisional Patent Application No. 61/039,339, filed Mar. 25, 2008, entitled "PHASE-CUT DIMMING CIRCUIT." The disclosures of each of these applications is incorporated by reference herein in their entirety.

BACKGROUND

The present invention relates to integrated circuits in general and, in particular, to phase-cut control circuits.

Phase-cut dimmer circuits are common circuits used in many commercial and residential applications for dimming and power control. For example, phase-cut dimmers are used to control light or heat output, motor speed, etc. They may be typically located inside standard wall receptacles (e.g., to interface with standard wall switches and outlets), or integrated with line cords or controlled equipment (e.g., a variable speed drill).

It is generally desirable to connect a phase-cut dimming circuit directly to the load it intends to control (e.g., the light bulb or heating element). A number of modern electronics applications, however, use integrated switching power circuitry. The switching power circuitry may cause the phase-cut dimming circuit to be unable directly to see the load. The indirect connection between the phase-cut dimmer and the load may provide undesirable or sub-optimal results, and may even permanently damage the load or other components.

As such, it may be desirable to provide functionality that optimizes the effectiveness to phase-cut dimming circuitry in the context of switched loads.

SUMMARY

Among other things, methods, systems, and devices are described for providing compatibility between phase-cut dimming circuitry and switched loads. Embodiments sense phase-cut dimming and convert the presence and amount of phase-cut dimming into analog and/or digital signals for use by power switching circuitry. The power switching circuitry may then use the signals to appropriately control their respective switched loads. Embodiments further provide preloading and startup control to maintain proper functioning of the circuitry in highly-dimmed conditions.

In one set of embodiments, a dimmer controller circuit arrangement is provided for use in a phase-cut dimming environment. The circuit arrangement includes a sensing module, configured to detect a conduction angle from a phase-cut voltage signal, the phase-cut voltage signal being generated by periodically cutting a periodic input voltage signal at the conduction angle; a logic processing module in operative communication with the sensing module and configured to generate a modulated output signal as a function of the conduction angle; and a load control signal generator module, in operative communication with the logic processing module and configured to generate a load control signal as a function of the modulated output signal. In some embodiments, the circuit arrangement further includes a housing configured to house at least a portion of the sensing module, the logic processing module, and the load control signal generator module.

In another set of embodiments, a circuit arrangement is provided for use in a phase-cut dimming environment. The circuit arrangement includes a phase-cut dimming module, configured to receive a periodic input voltage signal and cut the input voltage signal at a conduction angle to generate a phase-cut signal; a rectifier module, configured to rectify the phase-cut voltage signal to generate a bus voltage signal; and a dimmer controller module, operable to convert the phase-cut voltage signal to a load control signal as a function of the conduction angle. The dimmer controller module includes a sensing module, configured to detect the conduction angle from the phase-cut voltage signal; a logic processing module in operative communication with the sensing module and configured to generate a modulated output signal as a function of the conduction angle; and a load control signal generator module, in operative communication with the logic processing module and configured to generate a load control signal as a function of the modulated output signal.

Some embodiments further include a preload module, having a switched current generator configured to generate a current from the bus voltage signal, the current being switched as a function of the modulated output signal and the load control signal; and convert the current to a source voltage, wherein the dimmer control module is energized by the source voltage. Other embodiments further include a preload/startup module, having an under-voltage detector module, configured to compare a source voltage to an under-voltage threshold level, and to generate an under-voltage detect signal when the source voltage falls below the under-voltage threshold level; a pulse generator, configured to generate a pulse signal as a function of the modulated output signal and the load control signal, such that the pulse signal remains low until the conduction angle falls below a dimming threshold level; a logic component, configured to transition a current switch signal to high when at least one of the under-voltage detect signals is high or the pulse signal is high; and a switched current generator, configured to: generate a current from the bus voltage signal, the current being switched as a function of the current switch signal; and convert the current to the source voltage, wherein the dimmer control module is energized by the source voltage. Still other embodiments further include a load controller module, operatively coupled with the bus voltage signal and the load control signal, and configured to use the load control signal to control a load.

In yet another set of embodiments, a method is provided for controlling a switched load using phase-cut dimming. The method includes: receiving a phase-cut voltage signal, the phase-cut voltage signal being generated by periodically cutting a periodic input voltage signal at a conduction angle; detecting the conduction angle from the phase-cut voltage signal; generating a modulated output signal as a function of the conduction angle; and generating a load control signal as a function of the modulated output signal. In some embodiments, the method further includes comparing a source voltage to an under-voltage threshold level; generating an under-voltage detect signal when the source voltage falls below the under-voltage threshold level; generating a pulse signal as a function of the modulated output signal and the load control signal, such that the pulse signal remains low until the conduction angle falls below a dimming threshold level; transitioning a current switch signal to high when at least one of the under-voltage detect signals is high or the pulse signal is high; generating a current, the current being switched as a function of the current switch signal; and using the current to maintain the source voltage substantially within a desired range.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF EMBODIMENTS OF THE INVENTION

Many typical dimmer circuits used in commercial and residential applications include phase-cut dimmer circuits. The phase-cut dimmer receives a sinusoidal input voltage (e.g., typically mains line voltage), and "cuts" the waveform at some phase angle set by the dimmer control. This effectively switches the power being delivered to a connected load, thereby reducing the average power being seen by the load. Where the load is directly connected to the dimmer circuit, the reduced average power may directly result in a reduced load output (e.g., reduced brightness of a light bulb). However, where the load is switched (e.g., indirectly connected to the dimmer circuit), the switching circuitry may typically be incompatible with the dimming circuitry. For example, certain compact fluorescent bulbs, and other loads connected to switched power supplies or controllers may not work with typical phase-cut dimmers.

Phase-cut dimming circuits are typically based on circuit elements, like triacs, that fire upon some threshold input current, and maintain a conduction path as long as the input current remains above some holding level. When certain loads are directly connected to the dimming circuit, they continuously try to draw current over the entire half-cycle of the input voltage waveform. As such, the triac (or other similar element) may be fired at substantially any phase angle within the half-cycle and will maintain a current path to the load substantially for the remainder of the half-cycle. This may allow the load (e.g., a resistive light bulb) to be controlled over almost the entire range of phase angles from 0° to 180°.

Switched loads may create various undesirable scenarios for using phase-cut dimming. In one scenario, a controller switching the load may only operate within a certain range of rectified input voltages. As such, the usable output of the phase-cut dimmer may be limited only to the small range of voltages sufficient to drive the controller, and the phase-cut dimming may only work for a subset of phase angle selections (e.g., only from 90° to 180°). This may not provide a desirable level of dimming for the application. In other scenarios, equipment may even be permanently damaged by the switching load's incompatibility with the phase-cut dimmer.

Embodiments described herein provide compatibility between phase-cut dimming applications and switched power applications. For example, some embodiments include a dimmer controller for sensing phase-cut dimming and converting the presence and amount of phase-cut dimming into output analog and/or digital signals. Power switching circuitry may then use the output signals from the dimmer controller to appropriately control their respective switched loads.

Figure 1:
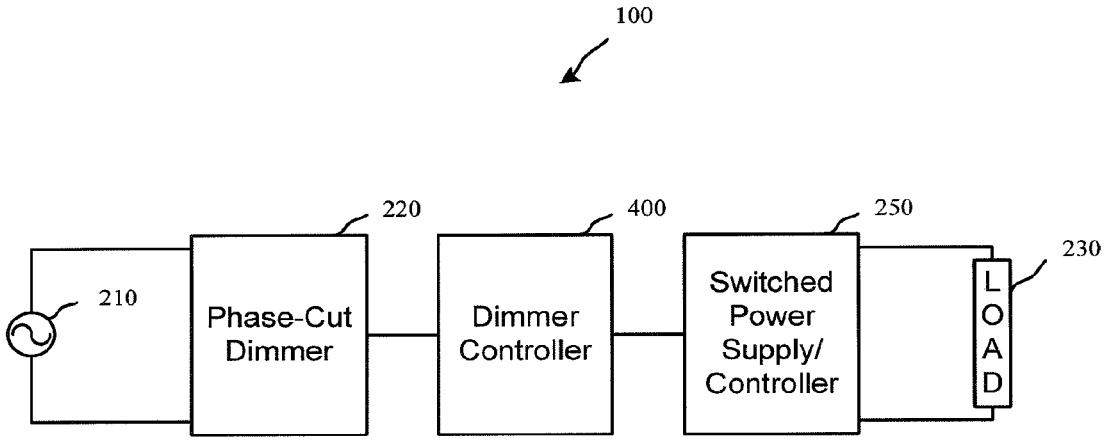
FIG. 1 shows a simplified block diagram of an exemplary system for providing dimming control using a dimming controller, according to embodiments of the invention.

FIG. 1 shows a simplified block diagram of an illustrative system for providing dimming control using a dimming controller, according to embodiments of the invention. The system 100 includes a phase-cut dimmer 220, a dimmer controller 400, and a switched power supply/controller 250. In embodiments of the invention, the dimmer controller 400 receives a phase-cut voltage signal representing a level of dimming. The dimmer controller 400 senses the level of dimming and generates one or more control signals that are compatible with the switched power supply/controller 250. The switched power supply/controller 250 may then use the control signal (or signals) to control the power to a load 230.

It will be appreciated that the term "dimming," as used herein, is intended to cover a variety of types of load characteristic control, depending on the application. For example, while "dimming" may suggest something like "making less bright" with respect to lighting applications, other applications may use "dimming" for speed control, volume or amplitude control, or other characteristics. Further, the term "transformer," as used herein, is intended to denote magnetic, or traditional, types of transformers. "Transformer" is not intended to include switched power circuits, or so-called "electrical transformers." Rather, phrases like "switching power circuitry" may include "electrical transformers" and other similar components.

In some embodiments, the phase-cut voltage is generated by various circuit components (e.g., in the form of the phase-cut dimmer 220), as discussed more fully with respect to FIGS. 2A-2D. In various embodiments, the phase-cut dimmer 220 receives an input voltage signal from a power source 210 and generates a phase-cut voltage signal representing the level of dimming. Embodiments of systems using dimmer controllers 400, like the one shown in FIG. 1, may then allow for the effective use of switched power supply/controllers 250 in the presence of the generated phase-cut voltages.

Despite their simplicity, phase-cut dimmers 220 work very well and are very inexpensive for many applications, which explains their popularity. They may be built using solid-state devices like silicon controlled rectifiers ("SCRs") or triacs, or any other functionally-similar component capable of blocking the full line voltage and handling the load current, and may control alternating current ("AC") loads from a few watts to many kilowatts. A number of phase-cut dimmers 220 are known in the art.

Figure 2A:
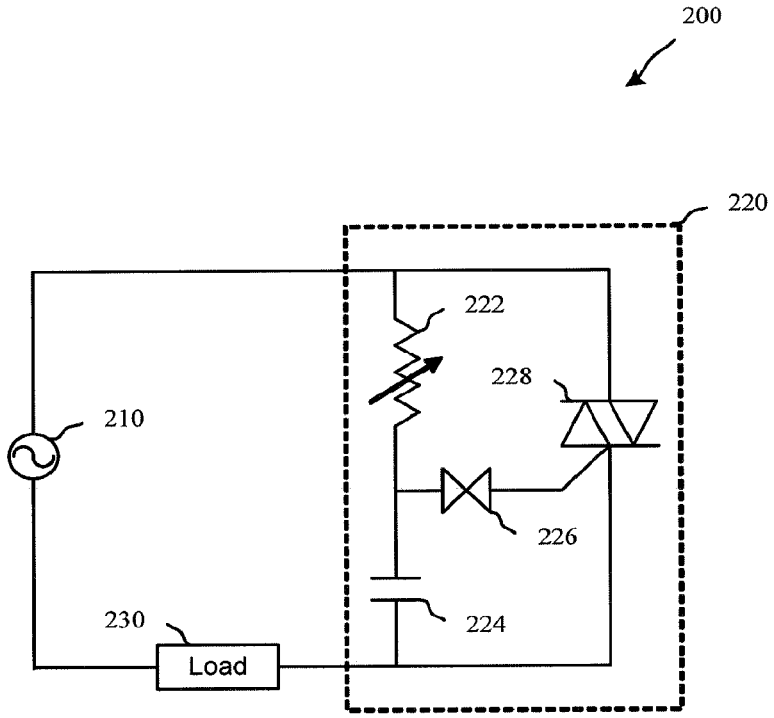
FIG. 2A shows a simplified circuit diagram of an exemplary phase-cut dimmer controlling the intensity of a load operated from an input voltage.

FIG. 2A shows a simplified circuit diagram of an exemplary phase-cut dimmer controlling the intensity of a load operated from an input voltage. The circuit 200 includes an input voltage source 210, a phase-cut dimmer circuit 220, and a load 230. The load 230 may be any resistive, inductive, reactive, or other type of load 230. For example, the load 230 may include a light bulb, a motor, a heating element, etc.

The phase-cut dimmer circuit 220 includes four components: a variable resistor 222, a capacitor 224, a trigger diode 226, and a triac 228. In some embodiments, the phase-cut dimmer circuit 220 further includes various components operable to filter or otherwise regulate undesirable electromagnetic artifacts. For example, capacitors and/or inductors may be used to filter current spikes, electromagnetic interference ("EMI"), and other artifacts.

The variable resistor 222 controls the load 230. In various embodiments, the variable resistor 222 is equipped with a knob, slider, or other adjustment control. The capacitor 224 is sized such that, when combined with the variable resistor 222, it generates an adjustable delay (e.g., by controlling the speed at which the capacitor charges).

The trigger diode 226 is operable to trigger the triac 228 when a certain input voltage is reached. The input of the trigger diode 226 is connected to the capacitor 224, such that the timing of the triggering will be based on the adjustable timing circuit that uses the capacitor 224 and variable resistor 222. In some embodiments, the trigger diode 226 is a diac or other similar electronic component.

When the trigger diode 226 triggers the triac 228, the triac 228 begins to conduct, acting substantially like a short circuit. Of course, the triac 228 does not provide a completely short circuit as there is a small voltage drop across the triac 228, but the drop may have little impact on the operation of the phase-cut dimmer circuit 220. The triac 228 will continue to conduct until the current across the triac 228 reaches zero (e.g., may be approximately where the input voltage from the input voltage source 210 reaches zero). It is worth noting that, because of the small voltage drop across the triac 228, the triac 228 may stop conducting (i.e., turn OFF) before the input voltage reaches a zero crossing. Additionally, the triac 228 may turn OFF before or after the input voltage reaches a zero crossing because of characteristics of the load (e.g., if the load is inductive). In some embodiments, the trigger diode 226 and triac 228 are integrated into a single component.

Figure 2B:
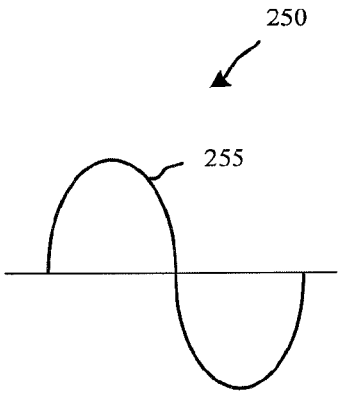
FIG. 2B shows an illustrative graph of one period of the input voltage across the input voltage source.

Functionally, the phase-cut dimmer circuit 220 converts a sinusoidal input voltage into a phase-cut voltage across the load 230. FIG. 2B shows an illustrative graph 250 of one period of the input voltage 255 across the input voltage source 210. For simplicity, it is assumed that the input voltage 255 across the input voltage source 210 is a perfect sine wave operating at a constant fundamental frequency (e.g., 60 Hertz). It will be appreciated, however, that the input voltage 255 may vary in fundamental frequency, include differing amounts of other frequencies (e.g., be "dirty" power), etc.

Figure 2C:
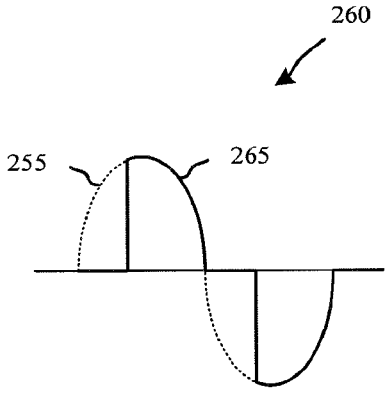
FIG. 2C shows an illustrative graph of one period of the load voltage.

FIG. 2C shows an illustrative graph 260 of one period of the load voltage 265 (i.e., the voltage across the load 230). The sinusoidal input voltage 255 is shown as a dashed line for reference. After a phase delay (e.g., regulated by the adjustable delay created from the combination of the variable resistor 222 and the capacitor 224 in FIG. 2A), the triac 228 turns ON (i.e., begins to conduct). While the triac 228 is ON, the load voltage 265 may approximate the input voltage 255. The triac 228 will remain ON while there is current flowing through its terminals, and will turn OFF at or slightly prior or subsequent to the zero crossing of the input voltage 255. As used herein, the phrase the "conduction angle" represents the time (or phase) difference between when the triac 228 turns ON in each half line cycle and when that half line cycle ends (e.g., approximately when the triac 228 turns OFF in that half line cycle).

These events repeat during each half-cycle of the input voltage 255. In this way, the load voltage 265 approximates a phase-cut version of the input voltage 255. By adjusting the variable resistor 222, the conduction angle may be changed. Changing the conduction angle may change the power in the load 230, thereby allowing the load 230 to be dimmed.

Figure 2D:
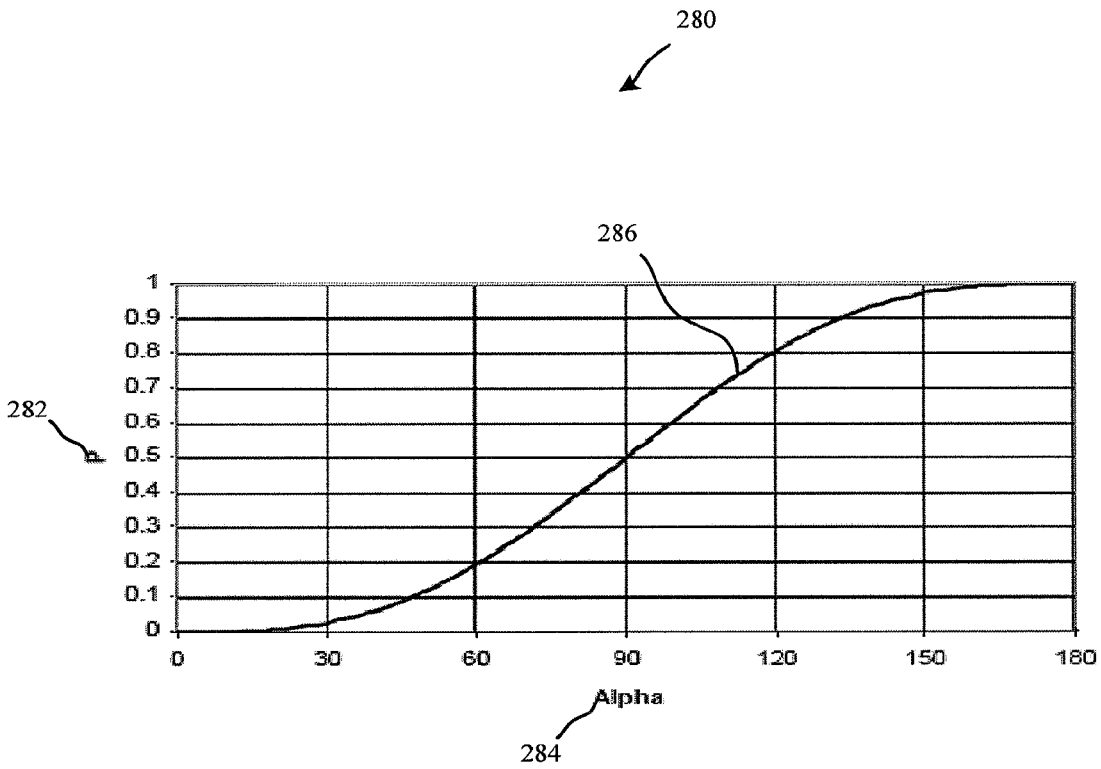
FIG. 2D shows an illustrative graph of the power in a load plotted against various conduction angles for a transfer function of an ideal phase-cut dimmer application.

FIG. 2D shows an illustrative graph 280 of the power 282 in a load plotted against various conduction angles 284 for a transfer function 286 of an ideal phase-cut dimmer application. The result shows a non-linear (e.g., S-shaped) transfer function 286. The transfer function 286 indicates that the load sees no power 282 when the conduction angle 284 is zero-degrees, and the load sees full power 282 when the conduction angle 284 is 180-degrees. In many typical phase-cut dimmer applications, the transfer function 286 may be highly progressive, allowing light bulbs and other loads to be adjusted to within a thousand-to-one range.

The transfer function 286 illustrates that phase-cut dimmers may work very well for many applications. However, phase-cut dimmers may be more effective where the dimmer circuit is directly connected to the load. It is worth noting that FIGS. 2A and 2D illustrate cases where the load is directly connected to the phase-cut dimmer circuitry, such that changes in conduction angle may be directly translated into changes in power to the load.

Many types of electronic equipment (e.g., components, appliances, etc.) contain circuitry to help regulate power going to the equipment's load. For example, some loads may require the mains line voltage to be converted to direct current ("DC"), a different voltage, a different current, etc. to provide certain power across the load. Some equipment uses transformers to regulate power to the load. Using transformers in a piece of equipment may essentially maintain a direct connection between the equipment's input voltage and the voltage across its load, which may allow the load to function properly when a phase-cut dimmer is added to the input voltage path.

An increasing number of types of equipment, however, have begun to use switching power circuits (e.g., a switched-mode power supply), instead of transformers, to regulate power to a load. Instead of dissipating power or using inductance, switching power circuits typically toggle power transistors rapidly between their ON and OFF states. This creates an output voltage that looks like a square wave (e.g., typically after some filtering) with a particular duty cycle. The duty cycle may be adjusted to regulate the average power output of the circuit.

With the increasing availability of inexpensive, high-performance switching devices (e.g., MOSFETs and IGBTs), many switching power circuits are more efficient, lighter, and smaller than the transformer counterparts. However, unlike transformers, using a switching power circuit in a piece of equipment may result in an indirect connection between the equipment's input voltage and the voltage across its load. This may limit the effectiveness of switching power circuits when a phase-cut dimmer is in the input voltage path, and may even cause damage to the equipment's load in certain applications.

For example, Compact Fluorescent Lights ("CFLs") are becoming a popular replacement to traditional filament bulbs because they often provide longer life, higher energy efficiency, and a reduced fire hazard. CFLs are manufactured by integrating switching power circuits into small ballasts, allowing the CFL bulbs to fit traditional filament bulb sockets. Because of the integrated switching power circuit, most CFLs will be permanently damaged when placed in a socket controlled by a phase-cut dimmer. Some manufacturers have begun to provide "dimmable" CFLs to avoid this problem. Dimmable CFLs typically avoid damage from phase-cut dimmers by "ignoring" a large part of the dimming range, allowing operation of the CFL bulb only within a relatively small and safe range of conduction angles. This may help ensure that power components are not allowed to operate in unsafe conditions when switching circuitry is starved of power. However, dimmers may have to reach a relatively high setting for the CFL to ignite, which may cause a significantly limited range of dimming (e.g., only ten-to-one).

In addition to CFLs, switching power circuits may be found in many televisions, radios, low-voltage halogen lighting, LED lighting, portable tools, battery chargers, etc. In many of these applications, bulky and heavy transformers have been replaced by smaller and less expensive switching power circuits. In many cases, such switching power circuits may be made highly extensible, operating in voltages ranging from 85 to 265 volts, and at frequencies ranging from 50 to 400 Hz. This extensibility may, for example, allow travelers to recharge or operate phones, laptops, or other devices on whichever line voltage is available anywhere in the world, without having to use additional converters or make other adjustments.

When using switching power circuits on a line with a phase-cut dimmer, the dimmer output may not be directly connected to the load. Instead, the output of the dimmer may feed a diode bridge and some switching power circuits, ultimately used to charge a tank capacitor. This, in turn, may feed the load and the power driver (or load controller) that controls it. Depending on the configuration, this type of arrangement may "ignore" the input voltage signal coming from the phase-cut dimmer until the conduction angle, being too low, no longer provides enough energy to properly operate. When this happens, the equipment may be starved of power and may stop working, malfunction, or even be permanently damaged.

Figure 3:
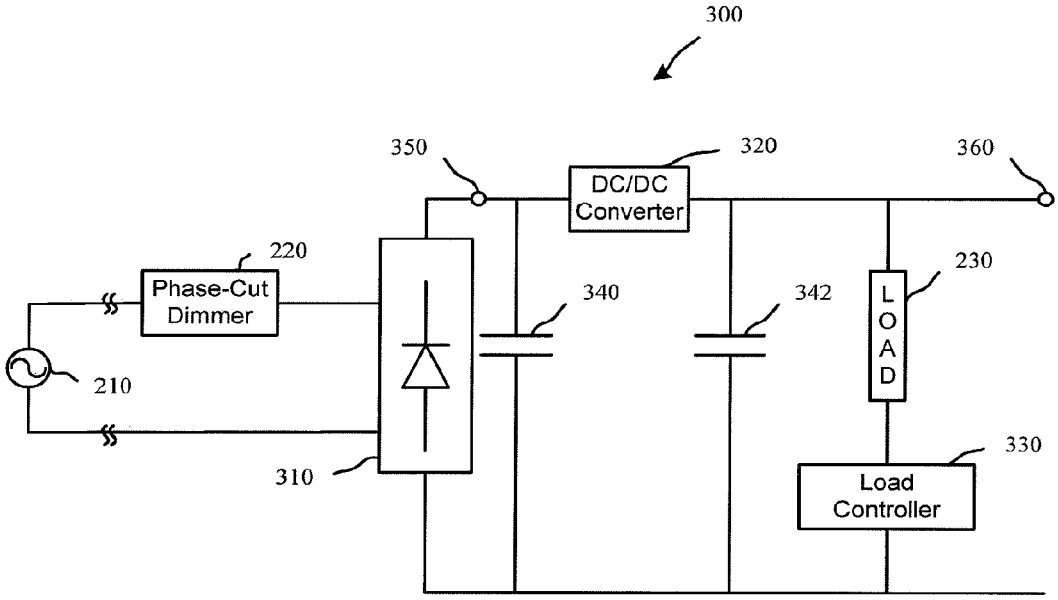
FIG. 3 shows an exemplary circuit diagram of an application containing both a phase-cut dimmer and equipment powered by a switched-mode power supply.

FIG. 3 shows an exemplary circuit diagram of an application containing both a phase-cut dimmer and equipment powered by a switched-mode power supply. As in FIG. 2A, the circuit 300 includes input voltage sources 210, a phase-cut dimmer circuit 220, and a load 230. Unlike FIG. 2A, however, the circuit 300 contains additional components typical of many switching power circuits, providing an exemplary illustration of the indirect connection between the phase-cut dimmer circuit 220 output and power to the load 230.

Particularly, the circuit 300 includes a load controller 330. The load controller 330 may operate as part of the power switching circuitry to convert a bus voltage 360 into a control signal for varying light, speed, or other parameter of the load 230. Typical load controllers 330 may be rated to operate only within an allowed voltage range. Voltages outside that range (e.g., higher or lower) may cause the load controller 330 and/or the DC/DC controller 320) to stop working, malfunction, or even become permanently damaged.

In some embodiments, sinusoidal output from a voltage source 210-1 is received by the phase-cut dimming circuit 220. The phase-cut dimming circuit 220 generates a phase-cut output voltage signal, which is then passed to a rectifier circuit 310 (e.g., a full-wave diode bridge). In other embodiments, sinusoidal output from a voltage source 210-2 is received directly by the rectifier circuit 310 (e.g., a full-wave diode bridge) without any phase-cutting (e.g., when no dimmer is present, or if the dimmer is set to a 180-degree conduction angle (i.e., fully ON)).

The rectified output 350 from the rectifier circuit 310 may then be passed to a DC/DC converter 320 to provide a bus voltage 360 to the load controller 330. As part of, or in addition to, the conversion to DC voltage, the switching power circuit may include a capacitor 340 or other components to generate a DC voltage (with ripple) from the rectified output 350. In some embodiments, the DC voltage is further filtered, stepped up or down, or otherwise processed to generate a bus voltage 360 compatible with the load controller 330. In certain embodiments, the bus voltage may be further filtered by a filter capacitor 342.

It will be appreciated that many of the embodiments described herein may be implemented in significantly more complex ways, or may use different components, for various reasons (e.g., to be more tolerant of noise, to be optimized for a particular application, etc.). As such, these descriptions are illustrative only, and should not be construed as limiting the scope of the invention in any way. For example, in some embodiments, the DC/DC converter 320 may include a power factor controller. For example, certain regulatory agencies may require that, in certain applications, load current is forced to be substantially proportional to load voltage. In this way, the load may be made to appear resistive. In certain of these embodiments, the rectified output 350 processed by the power factor controller may be used as a bus voltage 360 for the load controller 330. Typically, embodiments that include a power factor controller may not include the capacitor 340, as the capacitor may interfere with the operation of the power factor controller.

It will now be appreciated that an indirect connection between a phase-cut dimmer and a load (e.g., because of an intermediate switched power supply) may cause undesirable results. For at least these reasons, it may be desirable to sense the conduction angle from the output of a phase-cut dimmer circuit, and translate that information into a signal compatible with a switched load controller over a wide range of dimming, while avoiding damage or malfunction of the load.

Figure 4:
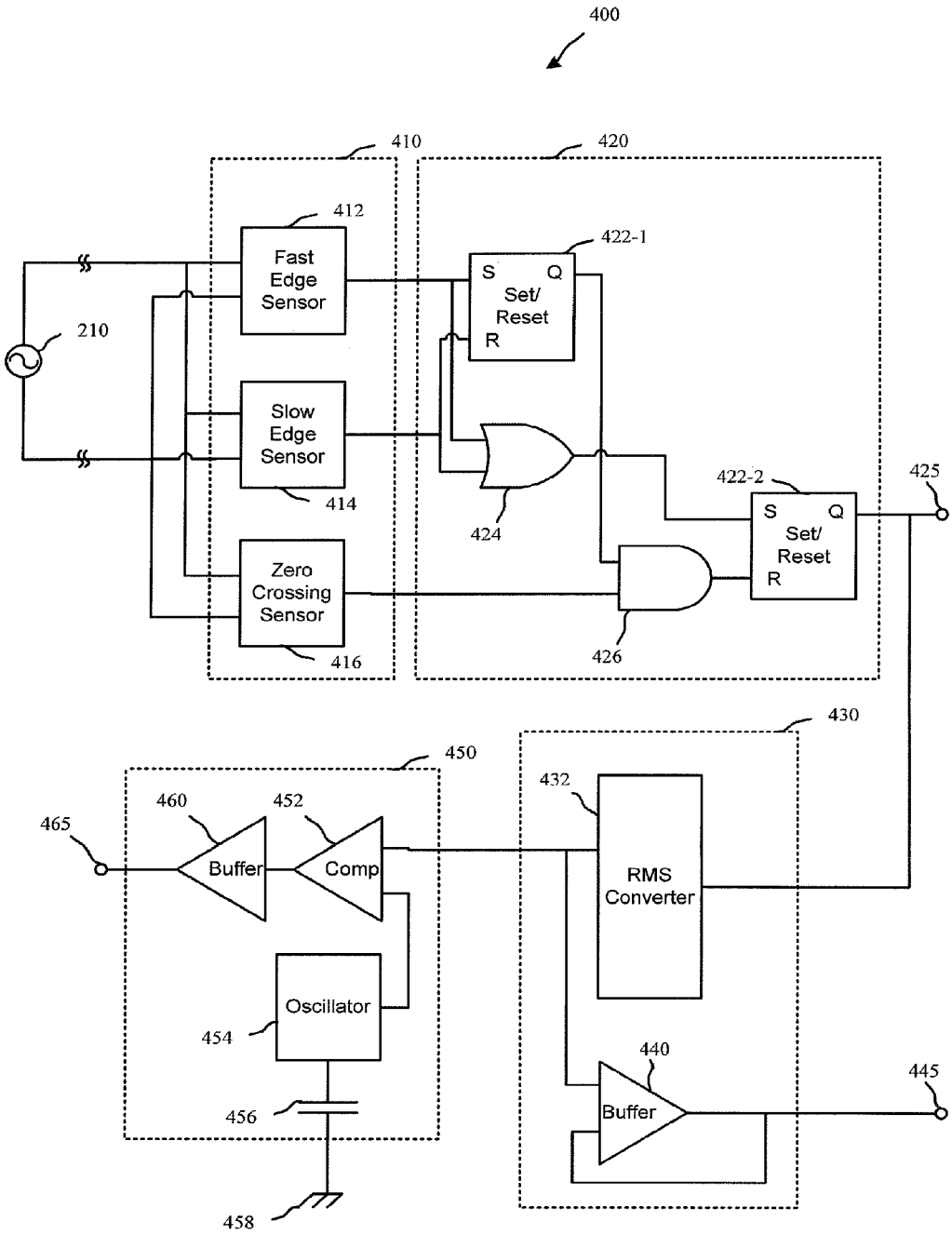
FIG. 4 shows a circuit diagram for an exemplary phase-cut sensing dimming controller circuit for use with switched power supply applications, according to embodiments of the invention.

FIG. 4 shows a circuit diagram for an exemplary phase-cut sensing dimming controller circuit for use with switched power supply applications, according to embodiments of the invention. The dimming controller circuit 400 includes a sensing unit 410 for sensing the conduction angle of a phase-cut dimmer (or for sensing that no phase-cut dimmer is present), an analog output unit 430 for generating an analog output signal 445, and a digital output unit 450 for generating a digital output signal 465. In some embodiments, the dimming controller circuit 400 also includes a logic processing unit 420 operable to generate a modulated output signal 425.

The sensing unit 410 senses the input voltage to determine the conduction angle (e.g., resulting from the presence or absence of a phase-cut dimmer). Sensing the conduction angle may include sensing (1) where the phase-cut dimmer turns ON (e.g., where the triac 228 in FIG. 2A fired), and (2) where the line voltage crosses zero at each half line cycle. The length of time (or phase difference) between (1) and (2) may be used to calculate the conduction angle of the phase-cut voltage signal. For example, if the triac 228 (FIG. 2A) fires thirty-degrees into each half line cycle (each half line cycle being 180-degrees), the conduction angle may be 180–30=150-degrees.

The sensing unit 410 may include some or all of a fast edge sensing unit 412, a slow edge sensing unit 414, and a zero-crossing sensing unit 416. The fast edge sensing unit 412 is operable to sense fast edges created by the phase-cut dimmer when it turns ON and/or OFF on every half line cycle. For example, a fast edge may be created at each half line cycle when the triac 228 (FIG. 2A) fires. Similarly, because of non-ideal components (e.g., non-zero voltage drop across the triac 228), the phase-cut dimming circuit may sharply turn OFF slightly before the end of the half line cycle, causing the output signal of the phase-cut dimmer to include a fast edge near the end of each half line cycle. It is worth noting that the length of time between the two fast edges in each half line cycle may be used to approximate the conduction angle of the phase-cut voltage signal. As such, some embodiments of the sensing unit 410 include only the fast edge sensing unit 412.

Only using the fast edge sensing unit 412 may be ineffective in some applications for a number of reasons. One reason is that, when there is no dimmer, there may be no fast edges, and the sensing circuit may not function properly. Similarly, where the conduction angle is approximately 180-degrees (e.g., because the dimmer is fully ON but still generates some fast edges due to non-ideal components), the edges may be difficult to detect in the presence of noise. Further, in both cases, it may be desirable for the circuit to determine that no dimmer is present (or that the dimmer is fully ON), and to output constant, full power to the load, with none of the fluctuations that may result from sensing fast edges using the fast edge sensing unit 412.

Another reason is that, where the input voltage is rectified and smoothed (e.g., by the capacitor 340 in FIG. 3), fast edges may be removed or difficult to detect in the presence of noise. For example, a bus voltage that has been rectified and smoothed (e.g., into DC with ripple) may include no fast edges for detection. As such, the fast edge sensing unit 412 may always see a 180-degree conduction angle, essentially "ignoring" the output of the phase-cut dimmer. Of course, the fast edge sensing unit 412 could be designed to detect edges even in the presence of smoothing circuitry, but this may make the circuit more complicated and/or less reliable in some cases.

In order to sense conduction angle where there are no fast edges (or where they are difficult to detect), some embodiments of the sensing unit 410 include the slow edge sensing unit 414. The slow edge sensing unit 414 is operable to detect sinusoidal-types of changes in the input voltage. This information may be used, for example, to determine where each half line cycle begins when there is no dimmer present (or when the dimmer is fully ON).

In some embodiments, the sensing unit 410 further includes the zero-crossing sensing unit 416 to sense where the input voltage crosses zero. The zero-crossing sensing unit 416 may aid in determining where each line half cycle begins and ends. In one embodiment, the zero-crossing sensing unit 416 includes a comparator with a threshold at zero (or slightly above zero, or with some hysteresis, to accurately sense zero crossings in the presence of noise).

In some embodiments, the sensing unit 410 will sense the conduction angle directly from the input voltage (e.g., before a rectifier bridge), while in other embodiments, the sensing unit 410 will sense the conduction angle after the input voltage is rectified. If the sensing is performed before the bridge (e.g., which rectifies the AC input voltage at the input of a switched-mode power supply), the input voltage signal to the sensing unit 410 is a phase-cut AC signal. In these cases, a standard zero crossing detection may work well in conjunction with the fast edge sensing unit 412 to detect conduction angle.

In some embodiments, the sensing unit 410 is energized by the output of the rectifier bridge. In these embodiments, sensing conduction angle before the bridge may be performed differentially. In certain implementations, differential sensing may make the circuit more complex (e.g., two pins may be required on an integrated circuit), but this type of configuration may also be applicable to more types of switched-mode power supplies. Still, it may be desirable in some implementations to save one pin on the integrated circuit by not sensing differentially, for example, after the bridge.

Sensing conduction angle after the bridge may yield certain difficulties, and may not work with many types of switched-mode power supplies. For example, once the AC input is rectified, there may no longer be any zero-crossing, since nothing is pulling down the voltage to zero or below zero. Therefore, the zero-crossing sensing unit 416 may have to be implemented with a positive threshold to detect the line cycles properly. In addition to potentially making the circuit more complex, many switched-mode power supplies (e.g., particularly ones with no power factor correction) use a capacitor right after the bridge to smooth the rectified AC and convert it into DC with ripple (as discussed above with reference to FIG. 3). When such capacitor is present, even a significantly positive threshold for the zero-crossing comparator may not work properly.

Many switched-mode power supplies (e.g., those with power factor correction) do not have an input capacitor, as the capacitor may corrupt the power factor correction. In these cases, sensing after the bridge may be possible. It is worth noting that recent regulations appear to be pushing manufacturers to produce switched-mode power supplies with power factor correction, making sensing after the bridge compatible with an increasing number of switched-mode power supplies.

In some embodiments, the output of the sensing unit 410 may be passed to a logic processing unit 420. The logic processing unit 420 is operable to convert the output of the sensing unit into a modulated output signal 425. For example, the modulated output signal 425 may be a pulse-width modulated output signal. In one embodiment, the logic processing unit 420 includes set/reset blocks 422 and logic gates 424 and 426. It will be appreciated that, while the illustrated embodiment is simplified so as not to obscure the embodiments or functionality of the invention, other embodiments of the logic processing unit 420 may be significantly more complex to account for noise and other artifacts.

In certain embodiments, the output of the logic processing unit 420 includes a modulated output signal 425, which has a characteristic proportional to the conduction angle. In one embodiment, the duty cycle of the modulated output signal 425 is proportional to the conduction angle. In some applications (e.g., motors or heaters using switched-mode power supplies), the modulated output signal 425 may be used directly by a load controller. Generally, however, the frequency of the modulated output may be the same as the frequency of the half line cycle (e.g., 120 Hz), which may be too slow to be useful for many applications and many manifest undesirable artifacts, including audible noise, voltage and/or current ripple, need for larger associated components (e.g., inductors), etc.

Of course, many types of logic processing units 420 are possible for producing the same or different types of modulated output signal 425. For example, the modulated output signal 425 may have a frequency composition that differs from a square wave, or the modulated output signal 425 may not be directly proportional (e.g., it may be inversely proportional, exponentially proportional, or mathematically related in some other useful way).

In certain embodiments, the modulated output signal 425 is generated to be at full conduction (e.g., 100-percent duty cycle) when the conduction angle is 180-degrees. In some embodiments, this is accomplished at the sensing unit 410 by using some or all of the fast edge sensing unit 412, the slow edge sensing unit 414, and the zero-crossing sensing unit 416, as discussed above. In other embodiments, this is accomplished by configuring the logic processing unit 420 to generate a full conduction modulated output signal 425 on the receipt of certain types of information from the sensing unit 410.

The modulated output signal 425 may be passed to the analog output unit 430. In some embodiments, the analog output unit 430 includes a root-mean-squared ("RMS") converter block 432 and a buffer 440. The RMS converter block 432 may calculate the RMS value (e.g., error) of the modulated output signal 425. In certain embodiments, the output of the RMS converter block 432 is passed to the buffer 440 to generate an analog output signal 445 that is mathematically related (e.g., proportional) to the conduction angle. The analog output signal 445 may be used, for example, in applications where a load controller requires simple analog dimming. It will be appreciated that the buffer 440 (or other components) may be configured to generate different types of analog output signals 445 from the modulated output signal 425 or the output of the RMS converter block 432. In some embodiments, non-linear and other transfer functions between the conduction angle and the analog output signal 445 are generated. For example, a square-law transfer function may be desirable for some applications.

As mentioned above, the modulated output signal 425 may essentially be a digital output signal, but its frequency may be too low for use by many applications. Further, the low-frequency modulated output signal 425 may manifest undesirable artifacts, including audible noise, voltage and/or current ripple, need for larger associated components, etc. As such, in some embodiments, the dimming controller circuit 400 includes a digital output unit 450 for generating a digital output signal 465 that may be more compatible with applications unable to directly use the modulated output signal 425. Certain embodiments of the digital output unit 450 include a comparator 452, an oscillator 454, and a buffer 460.

In one embodiment, the oscillator 454 is operable to generate a periodic signal of some frequency higher than the frequency of the modulated output signal 425. For example, the oscillator 454 may generate a triangle wave at three times the frequency of the modulated output signal 425. It will be appreciated that many periodic waveforms (e.g., square waves, saw-tooth waves, etc.) and many frequencies are possible for different applications. The oscillator 454 may be connected to ground 458 through a capacitor 456 in some implementations.

The comparator 452 may compare the output of the oscillator 454 and the RMS converter block 432 to generate a digital output signal 465 at the frequency of the oscillator 454. The output of the comparator 452 may be passed to a digital buffer 460 for buffering. The buffered signal may then be used as the digital output signal 465 by load controllers compatible with the signal. Of course, some applications may require that the digital output signal 465 is further filtered or otherwise processed prior to use. Further, for other applications, the digital output signal 465 and the analog output signal 445 may be used together for additional effect. For example, concurrent use of both signals may provide a significantly larger range of dimming, or more complex transfer functions, as desired.

Figure 5:
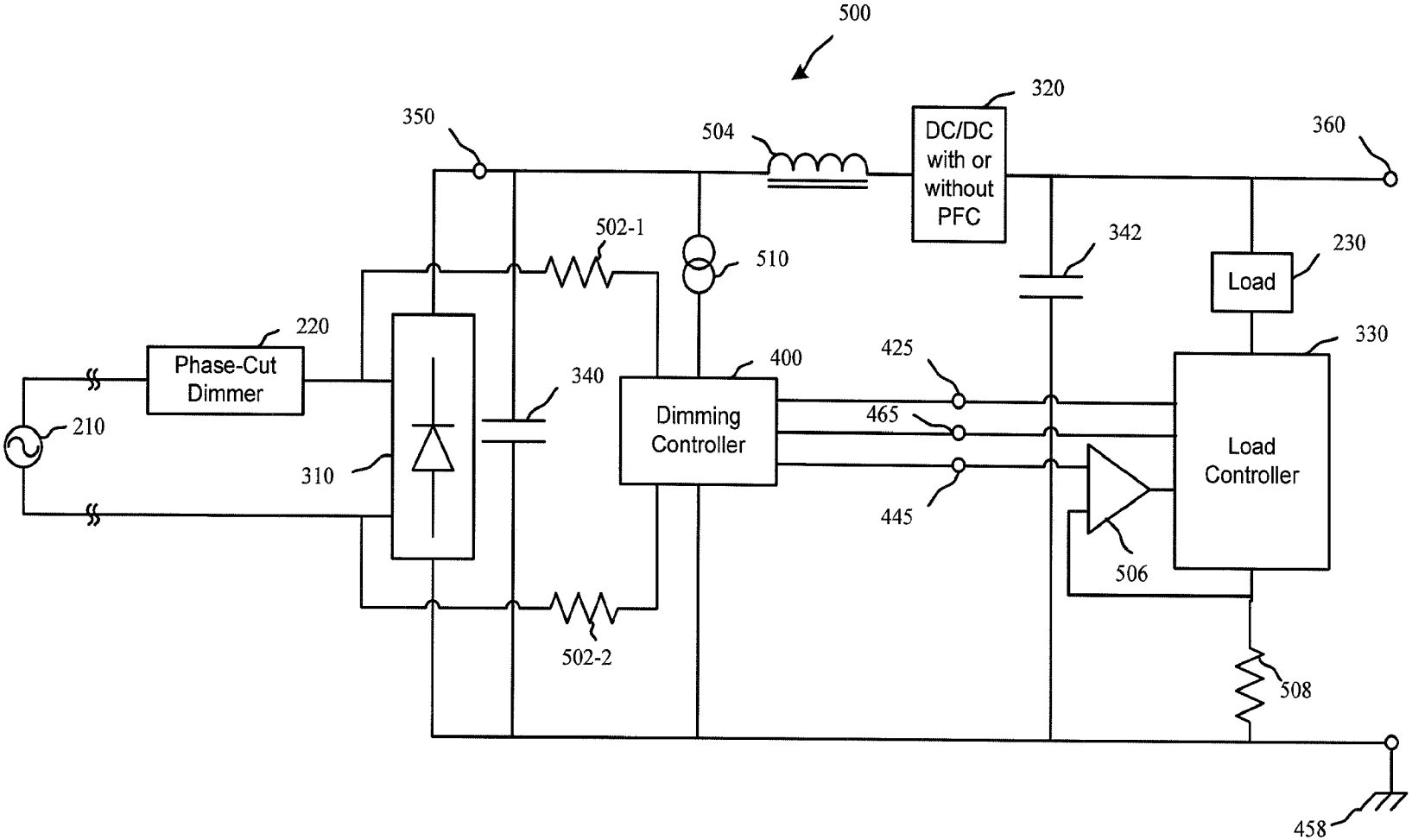
FIG. 5 shows an exemplary application circuit for using a phase-cut sensing circuit, like the dimming controller circuit in FIG. 4, according to embodiments of the invention.

FIG. 5 shows an exemplary application circuit 500 for using a phase-cut sensing circuit, like the dimming controller circuit 400 in FIG. 4, according to embodiments of the invention. An input voltage source 210 provides AC line voltage either through a phase-cut dimmer 220 or directly to generate an input voltage signal. The input voltage signal may then be rectified (e.g., by a rectifier bridge 310), generating a rectified voltage signal 350.

The rectified voltage signal 350 may be processed into a bus voltage signal 360. The processing of the rectified voltage signal 350 into the bus voltage signal 360 may involve the use of various components, including capacitors 340 and 342, an inductor 504, and a DC/DC converter 320 (with or without a power factor controller). The bus voltage signal 360 may be used by a load controller 330 to control power to a load 230. It is worth noting that in some embodiments, some of these components may be combined. For example, where there is no power factor controller, the DC/DC converter 320 and the load controller 330 may be combined into a single component (e.g., to reduce the number of power components).

As discussed above, the dimming controller circuit 400 may be configured to sense the conduction angle of the input voltage signal either before or after the rectification (e.g., before or after the bridge). In embodiments where the sensing is performed differentially, the application circuit 500 may include sensing resistors 502 in communication with the sensing unit of the dimming controller circuit 400. In embodiments where the sensing is not performed differentially (e.g., when the sensing is performed after the bridge), other configurations may be possible. In one embodiment, a first sensing resistor 502-1 is connected to the positive side of the bridge, and a second sensing resistor 502-2 is connected to the negative side of the bridge (e.g., system common). In another embodiment, the first sensing resistor 502-1 is connected to the positive side of the bridge, and the second sensing resistor 502-2 is omitted (e.g., to save one pin on an integrated circuit implementation).

In certain embodiments, the dimming controller circuit 400 is energized directly by the rectified voltage signal 350. In other embodiments, a current source 510 is provided between the dimming controller circuit 400 and the rectified voltage signal 350. The current source 510 may include, for example, a resistor, or more complex circuitry for supplying sufficient current to the dimming controller circuit 400.

Also as discussed above, the dimming controller circuit 400 may be configured to generate some or all of three different output signals: (1) a modulated output signal 425 (e.g., a PWM signal at twice the frequency of the line voltage); (2) an analog output signal 445; and (3) a digital output signal 465. Some, all, or a combination of these signals may be used by the load controller 330. For example, the analog output signal 445 and the digital output signal 465 may be combined in various ways to provide different amounts of progressivity of dimming (e.g., ten-to-one, 1000-to-one, etc.), different transfer functions (e.g., linear, exponential, logarithmic, parabolic, etc.). In certain applications, other components may be used to make the output of the dimming controller circuit 400 compatible with the load controller 330. For example, as shown, a resistor 508 and an error amplifier 506 may be used to adjust the load current. Of course, in these types of examples, other components may be required or desired to improve performance. For example, capacitors and resistors may be used with the error amplifier 506 to provide loop stabilization.

Figure 6:
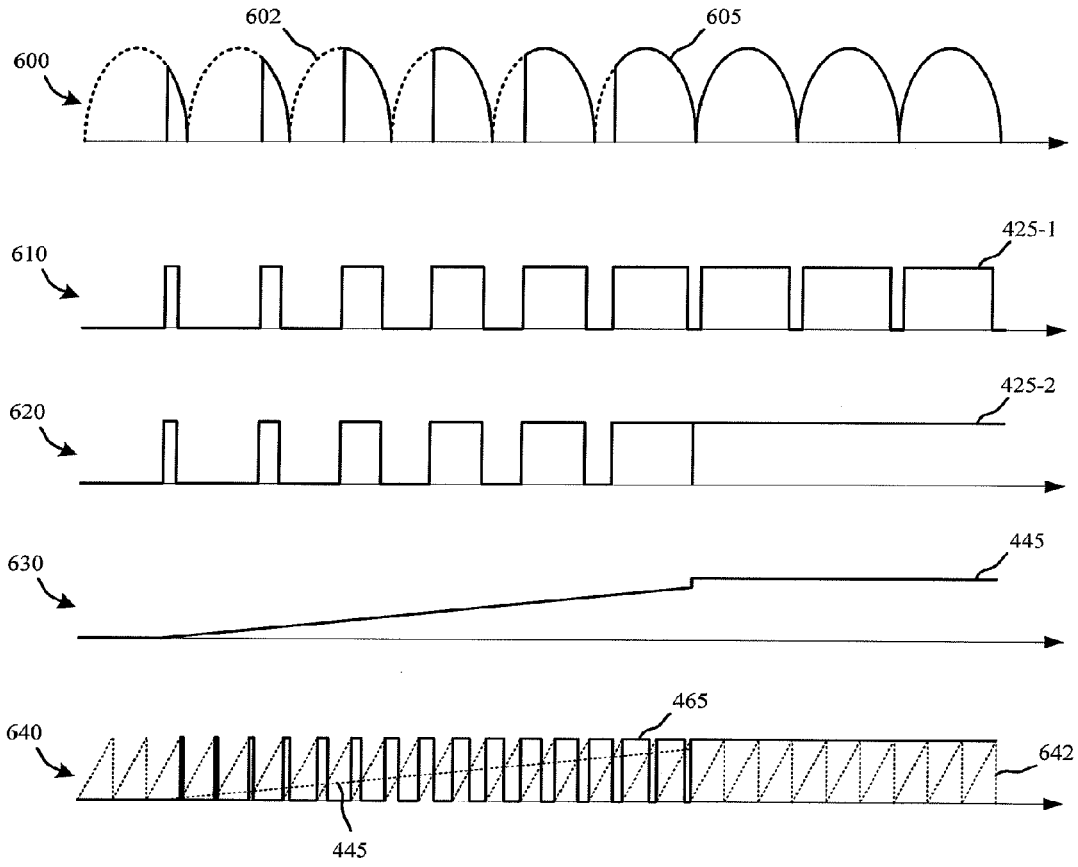
FIG. 6 illustrates a set of graphs of various voltage signals generated by an exemplary application circuit, like the one shown in FIG. 5, according to embodiments of the invention.

FIG. 6 illustrates a set of graphs of various voltage signals generated by an exemplary application circuit, like the one shown in FIG. 5, according to embodiments of the invention. The first graph 600 illustrates the output voltage signal from a phase-cut dimmer with a conduction angle that is changing from around 45-degrees to 180-degrees. For example, this may represent a case where a dimmer switch is being turned up from slightly ON to fully ON. The graph 600 shows the rectified phase-cut output voltage signal 605 overlaid on the rectified line voltage signal 602 (dashed line) for clarity.

As discussed above, some embodiments of dimmer controller circuits are configured to generate a modulated voltage output signal (e.g., the modulated voltage output signal 425 of FIG. 4). In a first set of embodiments, the modulated voltage output signal primarily uses fast edge detection to determine where the phase-cut dimmer turns ON and OFF in each half line cycle. The separation (phase or time) between the edges may then be used to calculate the conduction angle. In a second set of embodiments, however, additional sensing units and/or circuitry may be used to ensure that, when the input voltage has a conduction angle of 180-degrees (e.g., when the dimmer is fully ON or there is no dimmer), the dimmer controller circuit will be able to output a full conduction signal.

The second graph 610 shows an exemplary modulated voltage output signal 425-1 corresponding to the phase-cut output voltage signal 605 in the first set of embodiments. As shown, the duty cycle of the modulated voltage output signal 425-1 is directly proportional to the conduction angle of the phase-cut output voltage signal 605. Once the conduction angle of the phase-cut output voltage signal 605 reaches 180-degrees, however, the proportionality may break down to some extent. This may be due, for example, to a lack of a fast edge at the end of the half cycle (e.g., in conjunction with non-ideal components, noise, and other artifacts), or to the premature shut off of the triac prior to the end of the half cycle.

The third graph 620 shows an exemplary modulated voltage output signal 425-2 for the second set of embodiments. As with the modulated voltage output signal 425-1 in the second graph 610, the modulated voltage output signal 425-2 in the third graph 620 is directly proportional to the conduction angle of the phase-cut output voltage signal 605. In the third graph 620, however, when the conduction angle of the phase-cut output voltage signal 605 reaches 180-degrees, the proportionality is maintained by generating a full conduction output signal.

The fourth graph 630 shows an exemplary analog output signal 445 (e.g., the analog output signal 445 of FIG. 4) corresponding to the modulated voltage output signal 425-2 in the third graph 620. In some embodiments, the analog output signal 445 relates to the RMS value of the modulated voltage output signal 425-2. The fourth graph 630 illustrates that, as the conduction angle increases (e.g., as the dimmer is turned up), the analog output signal 445 increases proportionally.

The fifth graph 640 shows an exemplary digital output signal 465 (e.g., the digital output signal 465 of FIG. 4) corresponding to the modulated voltage output signal 425-2 in the third graph 620 and the analog output signal 445 in the fourth graph 630. In some embodiments the digital output signal 465 is generated by comparing the analog output signal 445 (shown as a dashed line in the fifth graph 640) against an oscillator output 642 (shown as dashed triangle wave in the fifth graph 640). The fourth graph 630 illustrates that the digital output signal 465 is high wherever the level of the analog output signal 445 exceeds the level of the oscillator output 642. In this way, as the conduction angle increases (e.g., as the dimmer is turned up), the analog output signal 445 increases proportionally, causing the duty cycle of the digital output signal 465 also to increase proportionally.

It will be appreciated that, in various embodiments, the modulated voltage output signal 425, the analog output signal 445, and/or the digital output signal 465 can be used to affect operation of components of a phase-cut sensing circuit, like those shown in the application circuit 500 of FIG. 5. For example, when a phase-cut dimmer is used to drive a switched load with a very low conduction angle, the load seen by the phase-cut dimmer may draw insufficient current for the phase-cut dimmer's triac (e.g., the triac 228 of FIG. 2A) to operate properly. In that environment, the triac may cease to fire and/or to maintain conduction. Additionally, when powering up in that environment, there may be insufficient voltage to drive the phase-cut sensing components (e.g., the dimming controller 400, DC/DC converter 320, etc. of FIG. 5). It may be desirable to use output signals from a dimmer controller to drive a preload/startup controller.

Figure 7:
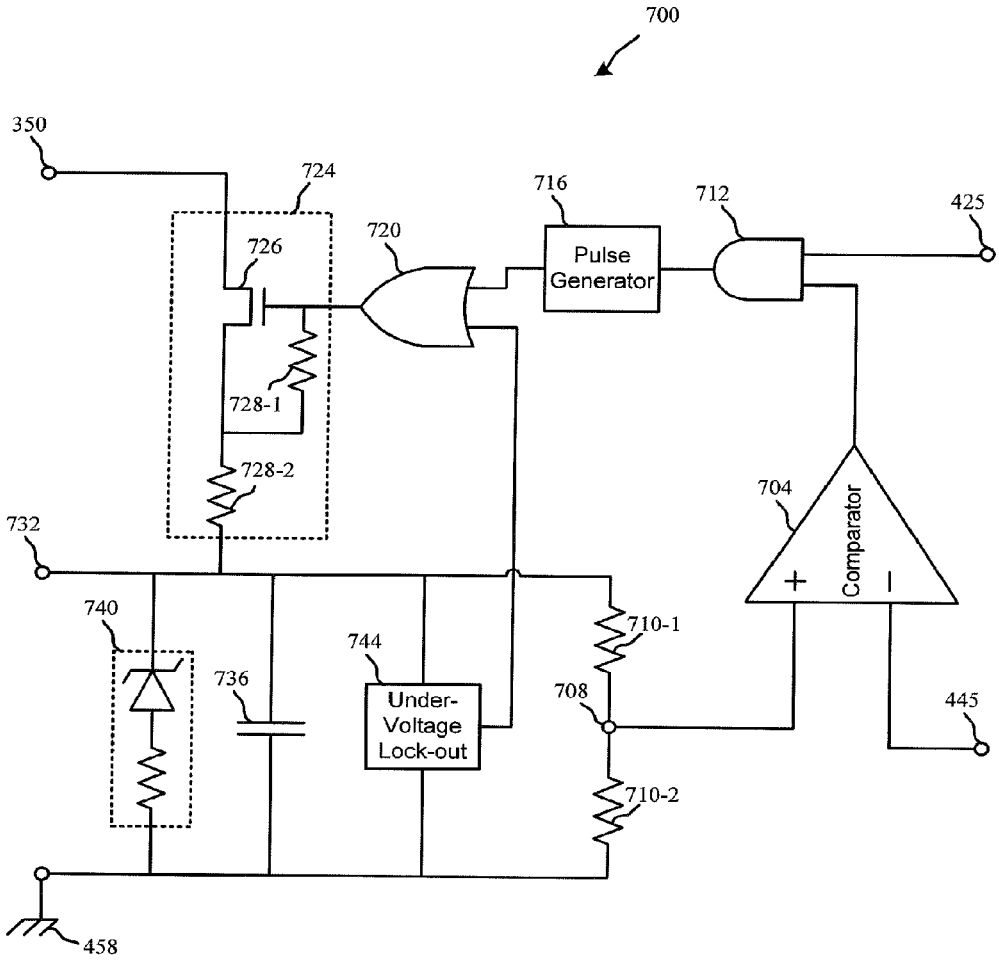
FIG. 7 shows a simplified schematic diagram of an embodiment of a preload/startup controller, according to various embodiments of the invention.

FIG. 7 shows a simplified schematic diagram of an embodiment of a preload/startup controller 700, according to various embodiments of the invention. The preload/startup controller 700 may operate in highly dimmed (i.e., low conduction angle) conditions to maintain sufficient current for proper operation of the phase-cut dimmer triac and/or to build up sufficient voltage for rapid startup and proper operation of the DC/DC converter (e.g., the DC/DC converter 320 of FIG. 5). In some embodiments, the phase cut block is energized by the same circuitry of from the output of the DC/DC converter. In certain embodiments, certain pre-loading circuitry, which may be needed at first start (e.g., cold start), is subsequently reduced or totally disabled, for example, to optimize efficiency for some applications. As shown, the modulated voltage output signal 425 and the analog output signal 445 of dimmer controller 400 of FIG. 4 are used to affect operation of a switched current source 724 (e.g., a depletion MOSFET 726 and two resistors 728), which provides triac preloading and component startup functionality.

The analog output signal 445 is received at the negative terminal of a comparator 704, and a reference voltage 708 is received at the positive terminal of the comparator 704. The reference voltage is set by using a resistor divider with two resistors 710 to divide a dimmer controller source voltage 732. When the conduction angle of the phase-cut dimmer is low, the analog output signal 445 from the dimmer controller (e.g., dimmer controller 400 of FIG. 4) will be at a low voltage level. When the voltage level of the analog output signal 445 drops below the reference voltage 708, the output of the comparator 704 will go high.

The output of the comparator 704 and the modulated voltage output signal 425 are received by an AND gate 712. As discussed above, the modulated voltage output signal 425 of the dimmer controller includes a pulse at each half cycle of the phase-cut signal at the input of the dimmer controller. Thus, when the conduction angle is low, the output of the comparator 704 will be high, and the modulated voltage output signal 425 will include a set of pulses, causing the output of the AND gate 712 to substantially mimic the modulated voltage output signal 425.

It will be appreciated that, when the conduction angle is very low, the pulse width of each pulse of the modulated voltage output signal 425 is very small. In some embodiments, the output of the AND gate 712 drives a pulse generator 716 (e.g., a "one shot"). The pulse generator 716 is used to output a pulse with a substantially constant duration (e.g., pulse width), independent of the duration of the incoming pulse 425. For example, the pulse generator 716 may effectively increase the pulse width of the output of the AND gate 712, by output a longer, constant-width pulse at each pulse coming from the AND gate 712.

An OR gate 720 receives the output of the pulse generator 716 and an output of an under-voltage lock-out module 744. The under-voltage lock-out module 744 senses the level of the dimmer controller source voltage 732, and generates a high output signal when the dimmer controller source voltage 732 falls below a threshold amount relating to an amount desired for proper startup of the dimmer controller. As such, the output of the OR gate 720 will remain low until either the conduction angle becomes very low and the triac is on (i.e., causing the incoming pulse 425 to be high), or the dimmer controller source voltage 732 falls below the threshold.

In the event that the dimmer controller source voltage 732 falls below the threshold, the output of the under-voltage lock-out module 744 will go high, causing the output of the OR gate 720 will go high. Applying the high output of the OR gate 720 to the switched current source 724 may cause current to begin flowing through the switched current source 724 (e.g., by opening up the MOSFET) from the rectified output voltage line 350 (e.g., as shown in FIG. 5). In the event that the conduction angle is very low, the pulse generator 716 will begin to generate a pulsed output, causing the OR gate 720 to similarly generate a pulsed output, and causing switched current to begin flowing through the switched current source 724 (e.g., by opening up the MOSFET with a duty cycle). In either event, the current will charge (or maintain charge on) capacitor 736, which will drive up the level of the dimmer controller source voltage 732.

Charging the capacitor 736 will drive up the level of the dimmer controller source voltage 732. When the dimmer controller source voltage 732 returns to a sufficiently high level, the output of the under-voltage lock-out module 744 will transition to low. In this way, the switched current source 724 and the under-voltage lock-out module 744 may operate to maintain sufficient voltage for startup of the dimmer controller and/or other phase-cut sensing components. Further, it will be appreciated that the load provided by the dimmer controller can be modeled essentially as a Zener diode in series with a resistor, between the dimmer controller source voltage 732 terminal and ground 458, as shown by block 740. As such, providing sufficient voltage across the dimmer controller (i.e., via the dimmer controller source voltage 732), may maintain sufficient loading from the perspective of the phase-cut dimmer's triac.

Figure 8:
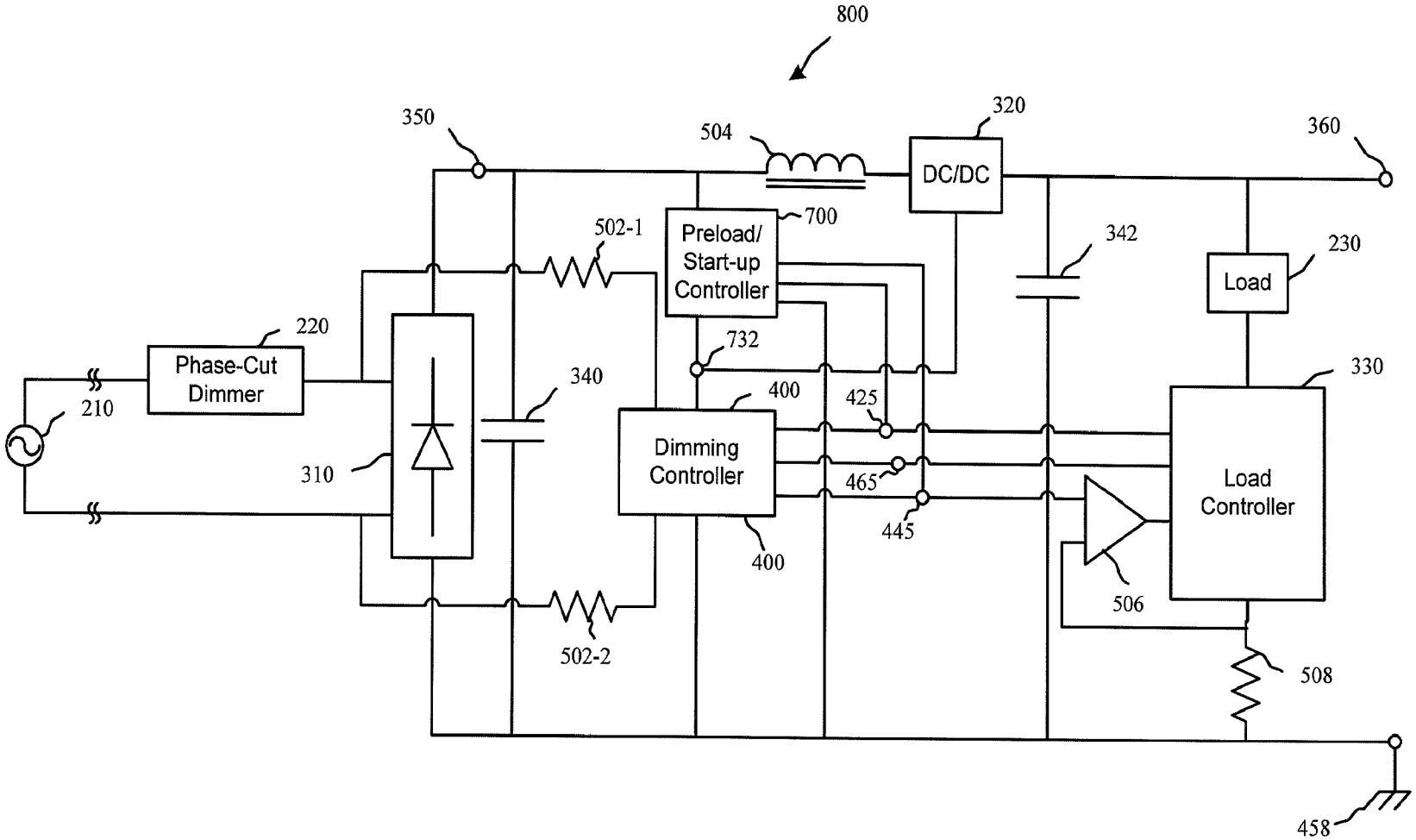
FIG. 8 shows another exemplary application circuit for using a phase-cut sensing circuit that includes a preload/startup controller, like the one shown in FIG. 7, according to embodiments of the invention.

For the sake of clarity, FIG. 8 shows another exemplary application circuit 800 for using a phase-cut sensing circuit that includes a preload/startup controller 700, like the one shown in FIG. 7, according to embodiments of the invention. Embodiments of the application circuit 800 operate like embodiments of the application circuit 500 of FIG. 5. As such, the application circuit 800 is described herein substantially only as it relates to the preload/startup controller 700. An input voltage source 210 provides AC line voltage either through a phase-cut dimmer 220 or directly to generate an input voltage signal. The input voltage signal may then be rectified (e.g., by a rectifier bridge 310), generating a rectified voltage signal 350.

The rectified voltage signal 350 may be used to controllably provide current using the preload/startup controller 700, as described with reference to FIG. 7. The current provided by the preload/startup controller 700 may then be used to drive the dimming controller circuit 400. As discussed above, the dimming controller circuit 400 may sense the conduction angle of the input voltage signal, and generate a modulated output signal 425, an analog output signal 445, and/or a digital output signal 465. Some, all, or a combination of these signals may be used by the load controller 330. Additionally, some or all of the signals may be fed back to the preload/startup controller 700, as described with reference to FIG. 7. In some embodiments, the preload/startup controller 700 is in communication with a DC/DC converter 320 (with or without a power factor controller) via signal node 732, as described with reference to FIG. 7.

Figure 9:
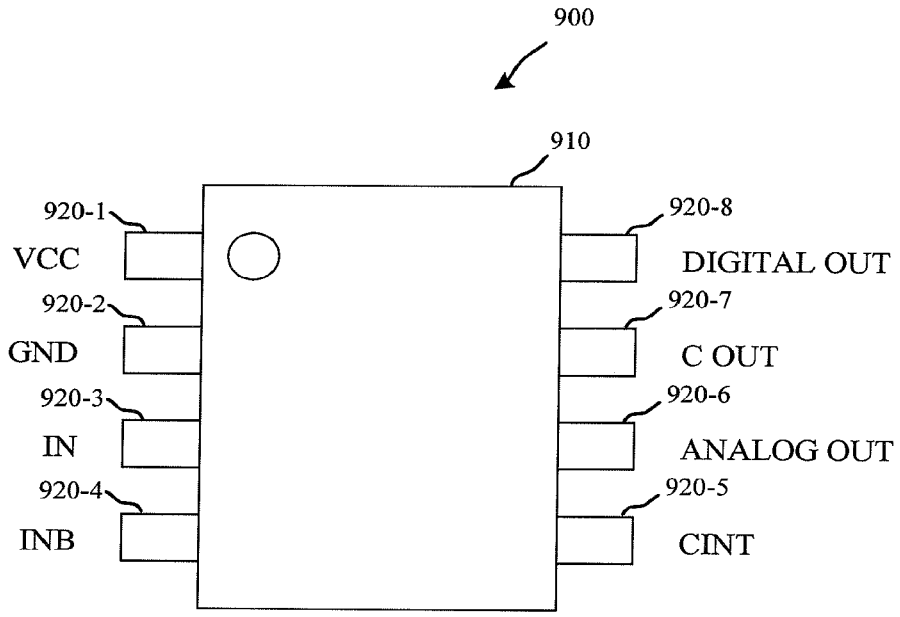
FIG. 9 illustrates an exemplary implementation of a dimming controller circuit as a solid state component, according to embodiments of the invention.

FIG. 9 illustrates an exemplary implementation of a dimming controller circuit as a solid state component, according to embodiments of the invention. The component 900 may include a housing 910 containing an integrated circuit with the components of the dimming controller circuit. The inputs and outputs of the dimming controller circuit may be in communication with a set of pins 920 coupled with the housing 910. For example, the pins 920 may include energizing inputs for the component (e.g., rectified input voltage and ground), conduction angle sensing inputs (e.g., one input if sensing after the bridge in some applications, two inputs if sensing before the bridge differentially), signal outputs (e.g., modulated voltage output signal, analog output signal, digital output signal, etc.), and other useful connections (e.g., pins for connecting to external capacitors, resistors, etc.). In some embodiments, the component includes a standard-sized integrated circuit housing 910 with a standard type and number of pins 920.

These units of the device may, individually or collectively, be implemented with one or more Application Specific Integrated Circuits (ASICs) adapted to perform some or all of the applicable functions in hardware. Alternatively, the functions may be performed by one or more other processing units (or cores), on one or more integrated circuits. In other embodiments, other types of integrated circuits may be used (e.g., Structured/Platform ASICs, Field Programmable Gate Arrays (FPGAs), and other Semi-Custom ICs), which may be programmed in any manner known in the art. The functions of each unit may also be implemented, in whole or in part, with instructions embodied in a memory, formatted to be executed by one or more general or application-specific processors.

Figure 10:
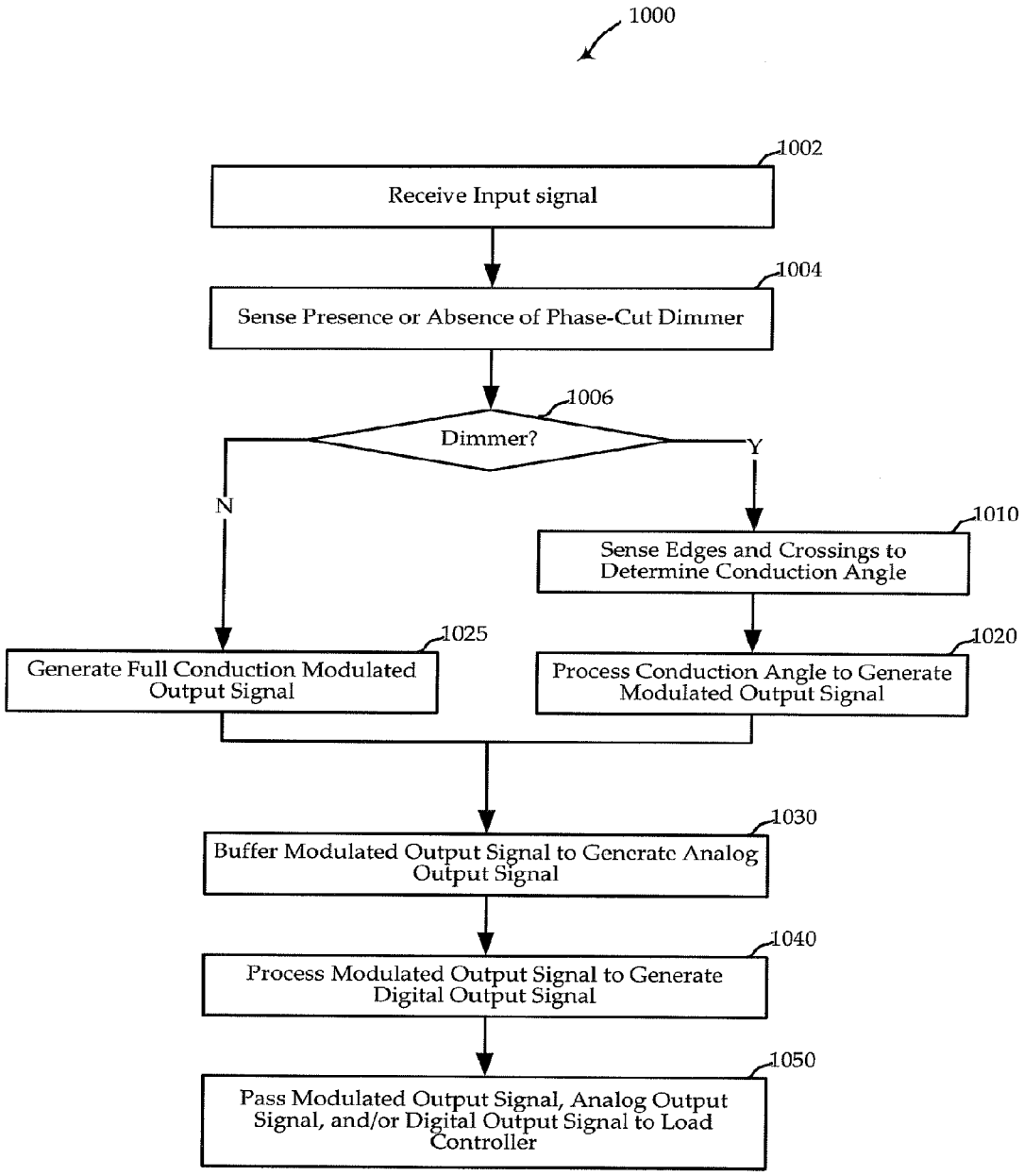
FIG. 10 provides a flow diagram of an exemplary method for sensing conduction angle to control phase-cut dimming in switched power applications, according to embodiments of the invention.

FIG. 10 provides a flow diagram of an exemplary method 1000 for sensing conduction angle to control phase-cut dimming in switched power applications, according to embodiments of the invention. The method 1000 begins by receiving a voltage input signal (e.g., rectified phase-cut voltage coming from a phase-cut dimming circuit) at block 1002. At block 1004, the method 1000 may sense whether or not a dimmer circuit appears to be present. In some embodiments, the presence or absence of a dimming circuit is sensed using a slow-edge sensing block. The "absence" of a dimmer may also indicate that a present dimmer is set to fully ON.

A decision block 1006 may then be reached, at which point different actions may be taken dependent on whether there is a dimmer. If a dimmer is present, edges and/or zero-crossings of the voltage input signal may be sensed and used to determine the conduction angle of the voltage input signal at block 1010. At block 1020, the conduction angle information may then be processed to generate a modulated output signal. If no dimmer is present, the method 1000 may generate a full-conduction modulated output signal at block 1025.

This modulated output signal may then be converted in block 1030 into an analog output signal. The modulated output signal may also be converted in block 1040 into a digital output signal. One or more of the output signals (i.e., those generated in blocks 1020, 1030, and 1040) may be passed alone or in combination to a load controller at block 1050.

Figure 11:
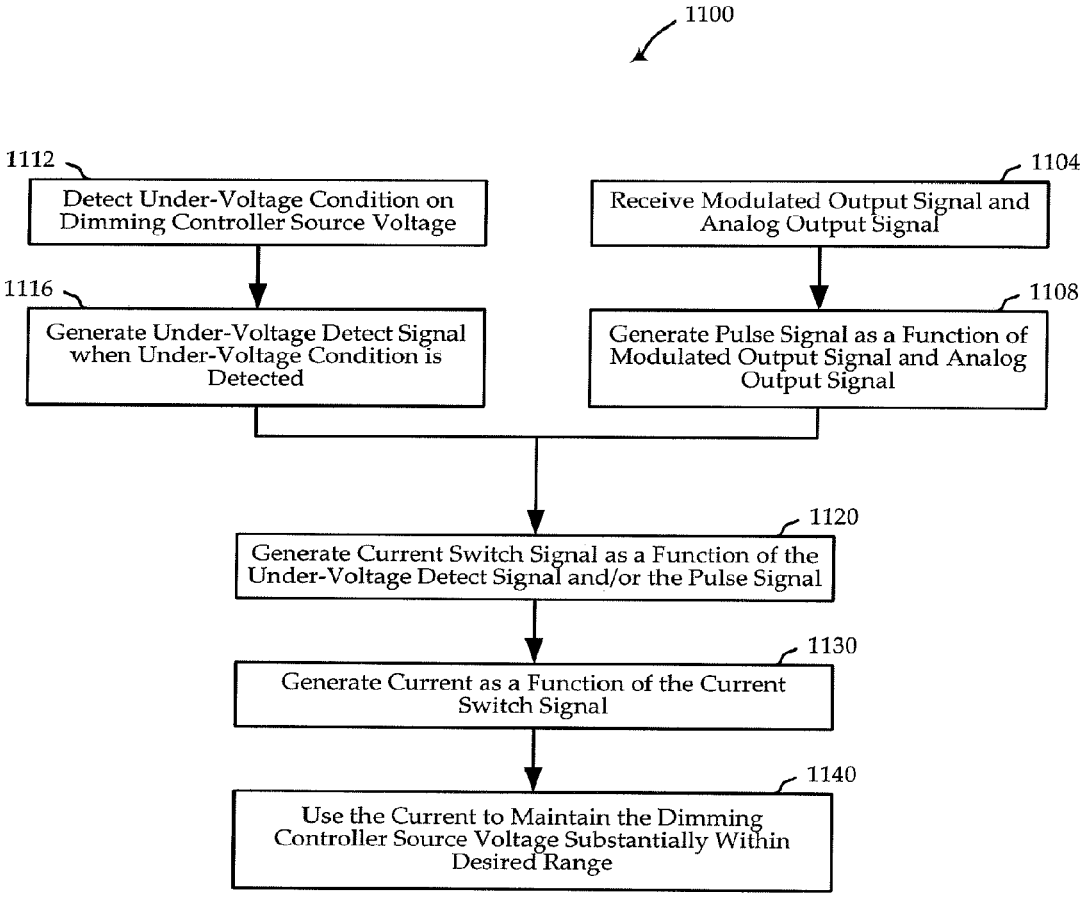
FIG. 11 provides a flow diagram of an exemplary method 1100 for maintaining a dimmer controller source voltage in low conduction angle conditions, according to embodiments of the invention.

Additionally, one or more of the output signals may be used to maintain a desired range of source voltages for a dimmer controller during low conduction angle conditions. For example, the output signals may be used to maintain proper loading for the phase-cut dimmer and/or to maintain sufficient voltage for startup of the dimmer controller. FIG. 11 provides a flow diagram of an exemplary method 1100 for maintaining a dimmer controller source voltage in low conduction angle conditions, according to embodiments of the invention.

The method 1100 begins at block 1104 by receiving a modulated output signal and an analog output signal from a dimmer controller. In some embodiments, the modulated output signal and the analog output signal are generated by blocks 1020 and 1030 of the method 1000 of FIG. 10, respectively. In block 1108, the modulated output signal and the analog output signal are used to generate a pulse signal. For example, when the conduction angle is above a threshold level, the pulse signal remains low. When the conduction angle falls below the threshold level, the pulse signal begins pulsing substantially following the frequency of the analog output signal. In some embodiments, the dimming control source voltage is measured at block 1112 to detect an under-voltage condition. When an under-voltage condition is detected, an under-voltage detect signal is generated at block 1116.

At block 1120, a current switch signal is generated as a function of either the pulse signal, the under-voltage detect signal, or both. For example, the pulse signal and the under-voltage detect signal may be tested with a logical OR function, so that the current switch signal is high whenever either or both of the pulse signal and the under-voltage detect signal is high. The current switch signal may then be used to generate a current at block 1130. The current may then be used in block 1140 to maintain the dimming controller source voltage substantially to within a desired range.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

It should also be appreciated that the following systems, methods, and software may individually or collectively be components of a larger system, wherein other procedures may take precedence over or otherwise modify their application. Also, a number of steps may be required before, after, or concurrently with the following embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Embodiments may be implemented by hardware, software, firmware, middleware, microcode, hardware description languages, or any combination thereof. When implemented in software, firmware, middleware, or microcode, the program code or code segments to perform the necessary tasks may be stored in a computer-readable medium such as a storage medium. Processors may perform the necessary tasks.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention, as described in the following claims.

What is claimed is:

1. A phase-cut dimming apparatus, comprising:

an input configured to receive a phase-cut voltage signal that is generated by periodically cutting a periodic input voltage signal at a conduction angle by a phase-cut dimmer;

a rectifier module coupled with the input and configured to rectify the phase-cut voltage signal to generate a rectified phase-cut voltage signal; and a current generator configured to generate a current from the rectified phase-cut voltage signal sufficient for proper operation of the phase-cut dimmer when the conduction angle is below a predetermined value, and not generate the current from the rectified phase-cut voltage signal when the conduction angle is not below the predetermined value.

2. The apparatus of claim 1, further comprising:

an under-voltage detector module configured to compare a source voltage to an under-voltage threshold level and to generate an under-voltage detect signal when the source voltage falls below the under-voltage threshold level, and wherein the current generator is further configured to generate ac current from the rectified phase-cut voltage signal as a function of the under-voltage detect signal.

3. The apparatus of claim 1, further comprising:

an under-voltage detector module, configured to compare the source voltage to an under-voltage threshold level and to generate an under-voltage detect signal when the source voltage falls below the under-voltage threshold level;

a pulse generator, configured to generate a pulse signal as a function of the modulated output signal and the load control signal, such that the pulse signal remains low until the conduction angle falls below a dimming threshold level; and a logic component, configured to transition a current switch signal to high when at least one of the under-voltage detect signal is high or the pulse signal is high, and wherein the current generator is switched as a function of the current switch signal.

4. The apparatus of claim 1, further comprising a dimmer controller module coupled with the rectifier module and operable to convert the phase-cut voltage signal to a load control signal as a function of the conduction angle.

5. The apparatus of claim 4, wherein the current generator is further configured to convert the current to a source voltage, and provide the source voltage to the dimmer control module.

6. The apparatus of claim 4, wherein the dimmer controller module comprises:

a sensing module, configured to detect the conduction angle from the phase-cut voltage signal, wherein the current generator is responsive to the sensing module to alternately generate the current and not generate the current;

a logic processing module coupled with the sensing module and configured to generate a modulated output signal as a function of the conduction angle; and a load control signal generator module, coupled with the logic processing module and configured to generate the load control signal as a function of the modulated output signal.

7. The apparatus of claim 6, wherein the load control signal generator module is further configured to generate a proportional output signal as a function of the modulated output signal, buffer the proportional output signal to generate an analog output signal such that a magnitude of the analog output signal is mathematically related to the conduction angle, and output the load control signal, the load control signal comprising the analog output signal.

8. The apparatus of claim 4, further comprising:

a load controller module coupled with the rectifier module and dimmer controller, and configured to receive the load control signal and control a load responsive to the load control signal.

9. The apparatus of claim 1, further comprising:

a housing configured to house at least a portion of the rectifier module, the dimmer controller module, and the preload module.

10. A method for controlling a switched load using phase-cut dimming, the method comprising:

receiving a phase-cut voltage signal that is generated by periodically cutting a periodic input voltage signal at a conduction angle with a phase-cut dimmer;

detecting the conduction angle from the phase-cut voltage signal;

comparing the conduction angle detected from the phase-cut voltage signal with a reference value; and identifying whether to generate a current from the rectified phase-cut voltage signal sufficient for proper operation of the phase-cut dimmer, the current being generated when the conduction angle detected from the phase-cut voltage signal is less than the reference value and the current not being generated when the conduction angle detected from the phase-cut voltage signal is greater than the reference value.

11. The method of claim 10, further comprising:

rectifying the phase-cut voltage signal to generate a rectified phase-cut voltage signal;

providing a portion of the rectified phase cut voltage signal to a dimmer controller;

detecting if the provided portion is less than a predetermined threshold; and generating current from the rectified phase-cut signal until said provided portion is no longer less than the predetermined threshold.

12. The method of claim 11, further comprising generating a load control signal at the dimmer controller as a function of the conduction angle.

13. The method of claim 10, further comprising:

converting the current to a source voltage; and providing the source voltage to a dimmer controller.

14. The method of claim 13, further comprising:

comparing the source voltage to an under-voltage threshold level;

generating an under-voltage detect signal when the source voltage falls below the under-voltage threshold level;

generating a pulse signal when the conduction angle falls below a dimming threshold level;

transitioning a current switch signal to high when at least one of the under-voltage detect signal is high or the pulse signal is high;

generating a current, the current being switched as a function of the current switch signal; and using the current to maintain the source voltage substantially within a desired range.

15. The method of claim 10, further comprising:

generating a modulated output signal as a function of the conduction angle;

generating a proportional output signal as a function of the modulated output signal; and buffering the proportional output signal to generate an analog output signal, providing the analog output signal to a switched load.

16. The method of claim 15, wherein a magnitude of the analog output signal is mathematically related to the conduction angle.

17. A phase-cut dimming apparatus, comprising:

an input configured to receive a phase-cut voltage signal that is generated by periodically cutting a periodic input voltage signal at a conduction angle by a phase-cut dimmer;

a rectifier module coupled with the input and configured to rectify the phase-cut voltage signal to generate a rectified phase-cut voltage signal; and a preload module coupled with the rectifier module, comprising:

a current generator configured to generate a current from the rectified phase-cut voltage signal sufficient for proper operation of the phase-cut dimmer when the conduction angle is below a predetermined value, and not generate the current from the rectified phase-cut voltage signal when the conduction angle is not below the predetermined value;

an under-voltage detector module configured to compare a source voltage to an under-voltage threshold level and switch the current generator to generate a current from the rectified phase-cut signal until the source voltage is no longer less than the under-voltage threshold level.

18. The apparatus of claim 17, wherein the preload module further comprises:

a pulse generator, configured to generate a pulse signal as a function of the conduction angle, such that the pulse signal remains low until the conduction angle falls below a dimming threshold level; and a logic component, configured to transition a current switch signal to high when at least one of the under-voltage detect signal is high or the pulse signal is high, and wherein the current generator is further configured to switch the current as a function of the current switch signal.

19. The apparatus of claim 17, further comprising:

a dimmer controller module coupled with the rectifier module and operable to convert the phase-cut voltage signal to a load control signal as a function of the conduction angle.

20. The apparatus of claim 19, wherein the dimmer controller module comprises:

a sensing module, configured to detect the conduction angle from the phase-cut voltage signal, wherein the current generator is responsive to the sensing module to alternately generate the current and not generate the current;

a logic processing module coupled with the sensing module and configured to generate a modulated output signal as a function of the conduction angle; and a load control signal generator module, coupled with the logic processing module and configured to generate a proportional output signal as a function of the modulated output signal, buffer the proportional output signal to generate an analog output signal such that a magnitude of the analog output signal is mathematically related to the conduction angle, and output the analog output signal to a switched load.

* * * * *